US011434842B1

(12) United States Patent
Zook et al.

(10) Patent No.: US 11,434,842 B1
(45) Date of Patent: Sep. 6, 2022

(54) DERATING OPERATING STRATEGY AND GASEOUS FUEL ENGINE CONTROL SYSTEM

(71) Applicant: Caterpillar Inc., Peoria, IL (US)

(72) Inventors: Brett A. Zook, Lafayette, IN (US); Christopher F. Gallmeyer, Chillicothe, IL (US); Karthik Jayasankaran, Dunlap, IL (US); Kamalakannan Thammireddi Vajram, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/181,231

(22) Filed: Feb. 22, 2021

(51) Int. Cl.
*F02D 41/22* (2006.01)
*F02D 41/00* (2006.01)

(52) U.S. Cl.
CPC ..... *F02D 41/22* (2013.01); *F02D 41/0002* (2013.01); *F02D 2200/0406* (2013.01)

(58) Field of Classification Search
CPC ..... F02D 35/027; F02D 2200/0406; F02D 2200/101; F02D 41/04; F02D 41/22; F02D 41/0002; F02D 41/1498
See application file for complete search history.

(56) References Cited

U.S. PATENT DOCUMENTS 2,467,732 A * 4/1949 Davis ..... F02D 35/027 340/579
4,322,948 A * 4/1982 Emmenthal ..... F02B 37/186 60/602
4,387,571 A * 6/1983 Katsumata ..... F02D 41/0007 60/602
4,542,727 A * 9/1985 Britsch ..... F02P 5/152 123/406.35
5,261,236 A * 11/1993 Ironside ..... F02D 41/0007 123/399
5,738,126 A * 4/1998 Fausten ..... F02D 41/0002 123/568.24
5,791,145 A * 8/1998 Freen ..... F02B 29/0412 123/434
6,021,755 A * 2/2000 Maddock ..... F02D 31/007 123/480
6,868,330 B2 3/2005 Saikkonen
7,690,352 B2 4/2010 Zhu et al.
8,333,072 B2 * 12/2012 Robinson ..... F02D 41/0007 60/602
8,567,355 B2 10/2013 Wang et al.
9,018,878 B2 4/2015 Hendrickson et al.
9,297,330 B2 3/2016 Svensson et al.
9,945,310 B1 * 4/2018 McQuillen ..... F01N 13/10
11,022,049 B1 * 6/2021 Martin ..... F01L 13/0015
(Continued)

*Primary Examiner* — Kurt Philip Liethen
(74) *Attorney, Agent, or Firm* — Brannon Sowers & Cracraft

(57) ABSTRACT

Operating a gaseous fuel engine system includes determining a detonation level in combustion cylinders in an engine in the gaseous fuel engine system, comparing the detonation level to a detonation level limit, calculating a detonation error, and limiting an engine load of the engine to a derated engine load level based on a reduction to intake manifold air pressure (IMAP) that is performed responsive to the detonation error. The gaseous fuel engine system can be operated at a reduced, derated engine load, rather than being shut down, and permitted to increase in engine load level as detonation events clear. Related control logic and structure are disclosed.

20 Claims, 3 Drawing Sheets

(56) References Cited

U.S. PATENT DOCUMENTS

2005/0279093 A1* 12/2005 Wang ..... F02B 29/0425 60/599
2006/0102136 A1* 5/2006 Bromberg ..... F02M 25/14 123/198 A
2006/0122765 A1* 6/2006 Nakao ..... G01L 23/225 701/111
2007/0157912 A1* 7/2007 Ritter ..... F02D 19/0631 123/526
2007/0215111 A1* 9/2007 Surnilla ..... F02D 19/0692 123/406.47
2009/0217906 A1* 9/2009 Nishimoto ..... F02D 41/0065 123/90.15
2010/0012086 A1* 1/2010 Demura ..... F02D 13/0249 701/112
2010/0037859 A1* 2/2010 Mashiki ..... F02D 35/027 123/436
2010/0121559 A1* 5/2010 Bromberg ..... F02D 19/084 123/436
2011/0106410 A1* 5/2011 Yoshino ..... F02D 41/04 701/103
2011/0168128 A1* 7/2011 Bradley ..... F02M 25/0222 123/294
2011/0313641 A1* 12/2011 Glugla ..... F02P 5/1528 701/104
2012/0080008 A1* 4/2012 Matsushima ..... F02D 41/2451 123/436
2012/0216774 A1* 8/2012 Oba ..... F02M 41/00 123/305
2012/0322614 A1* 12/2012 Cunningham ..... F02D 41/1497 477/54
2014/0278017 A1* 9/2014 Koi ..... F02P 5/15 701/111
2014/0311454 A1* 10/2014 Pursifull ..... F02M 21/0215 123/468
2014/0360179 A1* 12/2014 Doering ..... F02M 26/05 60/273
2016/0010581 A1* 1/2016 Sixel ..... F02D 41/3005 123/445
2018/0038300 A1* 2/2018 Hakeem ..... F02B 47/02
2018/0050780 A1* 2/2018 Anschuetz ..... B63H 20/10
2018/0171891 A1* 6/2018 McQuillen ..... F02D 41/0085
2019/0136769 A1* 5/2019 Jayasankaran ..... F02D 11/105
2019/0257253 A1 8/2019 Klingbeil et al.

* cited by examiner

DERATING OPERATING STRATEGY AND GASEOUS FUEL ENGINE CONTROL SYSTEM

TECHNICAL FIELD

The present disclosure relates generally to derated engine operation, and more particularly to reducing an engine intake manifold air pressure to limit engine load to a derated engine load level, based on a detonation error.

BACKGROUND

Internal combustion engines are used the world over in applications ranging from vehicle propulsion, operation of compressors, pumps, and various industrial equipment, to electrical power generation. Such engines operate on a diverse range of fuel types including petroleum distillate fuels, gaseous fuels such as natural gas, various blends, and dual fuel strategies. Internal combustion engines are compression-ignited, spark-ignited, or liquid fuel pilot ignited in most common implementations. In certain heavy-duty applications an engine can be expected to operate continuously for long periods of time, hundreds or thousands of hours without interruption, and commonly equipped with sophisticated monitoring and control systems to ensure that factors such as temperatures, pressures, efficiency, and other measures of performance remain within an optimal or acceptable range.

Most types of engines can at least occasionally experience a phenomenon known as detonation, where an unbridled rate of pressure rise occurs in an engine cylinder and radiates and advances from and between many points to cause an instantaneous explosion. Detonation events, known colloquially as "knock", can subject engine components to severe conditions, and certainly over time can result in engine failure that may be catastrophic or require shutdown for protection and/or servicing. A considerable degree of research effort has been invested in detecting and mitigating detonation itself or the conditions creating a risk of detonation in an effort to protect engines as well as ensure that service interruptions are as rare as practicable.

Various detonation detection strategies are known, employing sensors such as acoustic sensors or in-cylinder pressure sensors to detect the acoustic signatures of detonation or to monitor cylinder pressures to observe detonation directly. If detonation or other indicia of aggressive combustion is detected, a conventional strategy for enabling continued service of an engine is to "derate" the engine, in other words reducing an allowable engine load level from a rated load level. Since detonation is most often observed when an engine is operating at a relatively high engine load level, reducing allowable engine load can reduce or eliminate the incidence of detonation.

One problem with known derating strategies is that the engine may be reduced to a presumed safe load level that is considerably below a load level that the engine could sustain without detonation occurring to any considerable degree. In other words, in an effort to avoid engine damage most derating strategies overcompensate by reducing engine load more than necessary. Known strategies may also fail to permit the engine to return to desired load levels rapidly once detonation subsides. U.S. Pat. No. 9,297,330 to Svensson et al. proposes a system and method for estimating and controlling temperature of an engine component, where an engine component temperature can be detected or determined that justifies derating a power of the engine when an estimated temperature exceeds a threshold temperature. While Svensson et al. may have certain applications, there is always room for improvement and alternative strategies relating to engine derating.

SUMMARY OF THE INVENTION

In one aspect, a method of operating an engine system includes determining a detonation level associated with detonation in a plurality of combustion cylinders in an engine in the engine system, and comparing the detonation level to a detonation level limit. The method further includes calculating a detonation error based on the comparison of the detonation level to the detonation level limit, and reducing an engine intake manifold air pressure (IMAP) of the engine based on the detonation error. The method still further includes limiting an engine load of the engine to a derated engine load level based on the reduction to the IMAP of the engine.

In another aspect, a gaseous fuel engine control system includes a plurality of detonation sensors, and an electronic control unit coupled with the plurality of detonation sensors. The electronic control unit is structured to receive detonation data produced by the plurality of detonation sensors indicative of a detonation level in a plurality of combustion cylinders in a gaseous fuel engine, and to calculate a detonation error based on a difference between the detonation level and a detonation level limit. The electronic control unit is further structured to determine an intake manifold air pressure (IMAP) command based on the detonation error, and to limit an engine load of the engine to a derated engine load level based on the IMAP command.

In still another aspect, an engine control unit for a fumigated gaseous fuel engine system includes a computer readable memory storing executable instructions for limiting detonation in combustion cylinders in a gaseous fuel engine, and a data processor coupled with the computer readable memory and structured, by executing the executable instructions, to determine a detonation level associated with detonation of gaseous fuel in the combustion cylinders, compare the detonation level to a detonation level limit, and calculate a detonation error based on the comparison of the detonation level to the detonation level limit. The data processor is further structured, by executing the executable instructions, to determine an intake manifold pressure (IMAP) command based on the detonation error, command a varied position of a fuel and air intake throttle in the fumigated gaseous fuel engine based on the IMAP command, and limit an engine load of the fumigated gaseous fuel engine to a derated engine load level based on the commanded varying of the position of the fuel and air intake throttle.

DETAILED DESCRIPTION

Figure 1:
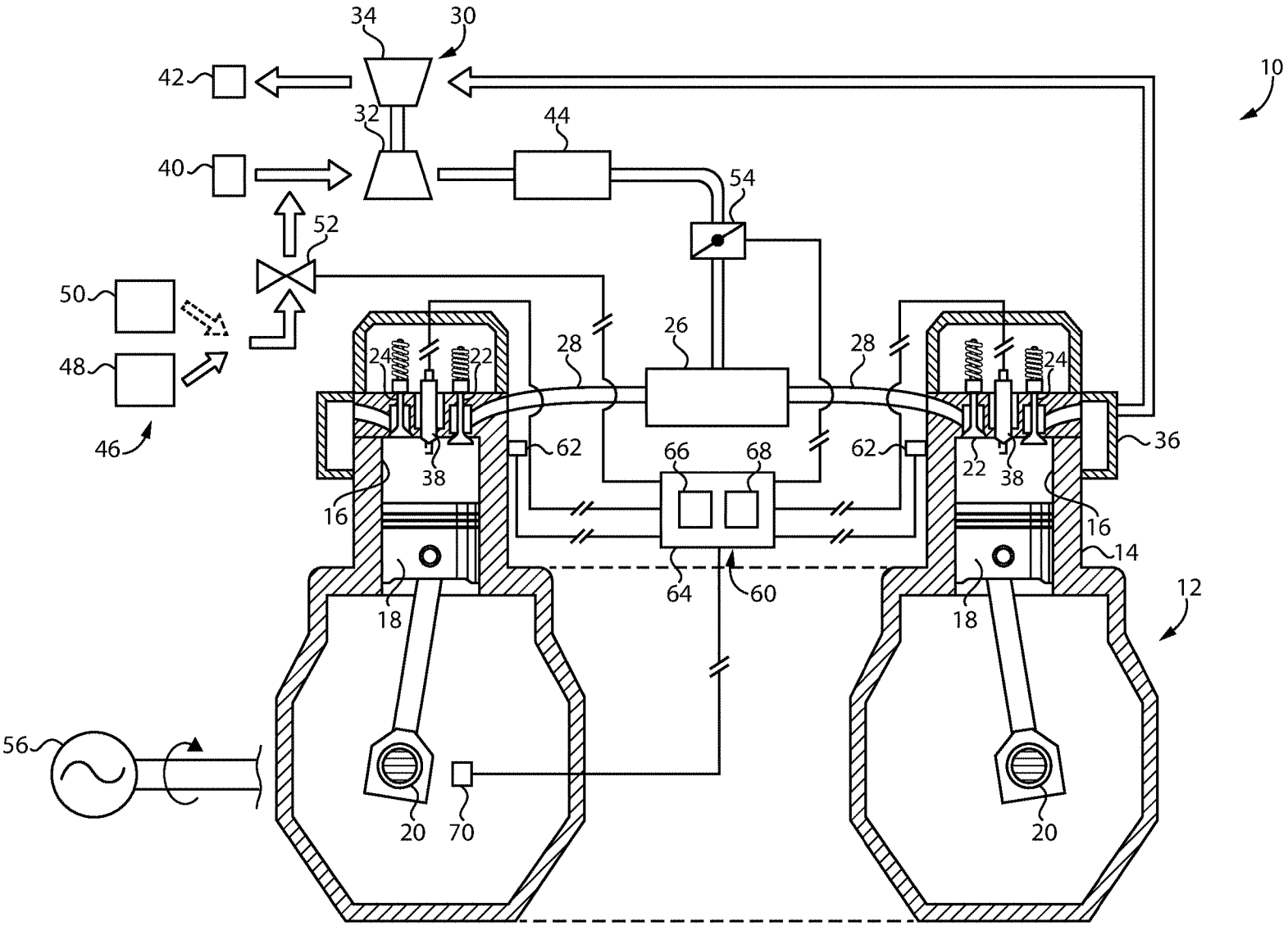
FIG. 1 is a diagrammatic view of a gaseous fuel engine system, according to one embodiment.

Referring to FIG. 1, there is shown a gaseous fuel engine system 10 according to one embodiment. Engine system 10 includes a gaseous fuel engine 12 having an engine housing 14 with a plurality of combustion cylinders 16 formed therein. Pistons 18 are positioned within combustion cylinders 16 and each movable between a top dead center (TDC) position and a bottom dead center (BDC) position, typically in a conventional four-stroke engine cycle. Combustion cylinders 16 can include any number of cylinders in any suitable arrangement such as a V-pattern, an in-line pattern, or still another. Pistons 18 are coupled to a crankshaft 20 that is rotatable in response to the reciprocation of pistons 18. In the illustrated embodiment crankshaft 20 is coupled to an electrical generator 56. Electrical generator 56 can be in turn electrically coupled by way of suitable switchgear to an electrical power grid. In other embodiments engine system 10 could be applied for vehicle propulsion, powering a pump or a compressor, or in a variety of other applications.

Each of combustion cylinders 16 is associated with one or more intake valves 22 and one or more exhaust valves 24. An intake manifold 26 receives a flow of intake air and fumigated gaseous fuel for supplying to combustion cylinders 16 by way of intake runners 28. Engine system 10 further includes a turbocharger 30 having a compressor 32 positioned fluidly between an air inlet 40 and an aftercooler 44, to supply compressed and cooled air, along with gaseous fuel, to intake manifold 26. Turbocharger 30 further includes a turbine 34 positioned to receive a flow of exhaust from an exhaust manifold 36 collecting the exhaust from combustion cylinders 16. Exhaust fed through turbine 34 rotates turbine 34 in a conventional manner and is subsequently fed to an exhaust outlet 42 such as an exhaust stack or a tailpipe. Aftertreatment equipment (not shown) may be positioned fluidly between turbine 34 and exhaust outlet 42. Engine 12 may be spark-ignited, employing an electrical spark for igniting gaseous fuel for combustion in combustion cylinders 16, with each of combustion cylinders 16 associated with a sparkplug 38.

Engine system 10 further includes a fuel system 46. Fuel system 46 includes a fuel supply 48 and an electronically controlled fuel admission valve 52 positioned to controllably deliver a gaseous fuel from fuel supply 48 into a flow of intake air from air inlet 40 at a location upstream of compressor 32. Fuel system 46 is also shown having another fuel supply 50. According to the present disclosure engine system 10 may switch between fuel supplies 48 and 50 in some instances. Fuel supply 48 and fuel supply 50 might include, respectively, a line gas supply and a locally stored gas supply. Fuel supplies 48 and 50 could also include a single fuel "supply" that receives different feeds of gaseous fuel at different times. In other words, engine system 10 could be connected to a single supply of line gas, for example, that receives different feeds of gaseous fuel, at times, in a manner that will be familiar to those skilled in the art. Suitable gaseous fuels can include natural gas, propane, methane, landfill gas, biogas, blends of these, or still others.

It has been observed that detonation in combustion cylinders 16 can be observed where switching from one gaseous fuel supply or one gaseous fuel type to another. Line gas or other gaseous fuel supplies can vary in fuel quality, and in some instances fuel quality can vary over the course of time, and detonation observed when a fuel quality change occurs. As noted above, in many applications it is desirable for an engine to be able to be operated without interruptions in service that might occur such as where engine shutdown is required due to detonation or perceived risk of detonation. While in some instances engine derating can be used to reduce engine load and reduce or eliminate detonation, conventional derating strategies tend to overcompensate and place limitations on engine load that go further than necessary, require maintenance, servicing, or observation, before engine load levels can be increased once more, or have other limitations. As will be further apparent from the following description, the present disclosure contemplates operating engine system 10 at a derated engine load level when detonation is detected but advantageously permits load level to be restored relatively rapidly and without intervention or otherwise undesired activities or diagnostics.

To this end, engine system 10 further includes a gaseous fuel engine control system 60. Control system 60 includes a plurality of detonation sensors 62 structured to produce detonation data indicative of a detonation level in combustion cylinders 16 in gaseous fuel engine 12. Detonation sensors 62 may include acoustic sensors attached to or otherwise in contact with engine housing 14 in some embodiments. In other instances, detonation sensors 62 could include in-cylinder pressure sensors, a combination of acoustic sensors and in-cylinder pressure sensors, or any other suitable sensor(s) or sensor group capable of detecting or inferring detonation events in a plurality of combustion cylinders in a gaseous fuel engine.

It will be recalled gaseous fuel engine 12 includes sparkplugs 38 associated one with each of combustion cylinders 16, and in the illustrated embodiment having spark gaps positioned within main combustion chambers of each of combustion cylinders 16. In other embodiments engine 12 could be prechamber-ignited, employing prechamber ignition devices fluidly connected with combustion cylinders 16, and each typically including a spark gap therein in a generally known manner. In a prechamber ignition application, the prechamber ignition devices might be fed with dedicated separate supplies of the primary gaseous fuel for gaseous fuel engine 12, or a different fuel, for example, although the present disclosure is not thereby limited. Sparkplugs 38 could themselves be so-called prechamber sparkplugs in some embodiments where the spark gaps are within a prechamber formed in a prechamber sparkplug housing, extending into a combustion cylinder. In still other instances, engine system 10 could be a dual fuel engine system operating on a primary gaseous fuel that is pilot-ignited with direct injections of a liquid pilot fuel, such as a diesel distillate fuel. It will also be recalled gaseous fuel admission valve 52 is positioned to admit gaseous fuel at a location upstream of compressor 32. In other instances gaseous fuel engine 12 could be port-injected with fuel delivered, for example, at a location fluidly between intake manifold 26 and combustion cylinders 16, or delivered directly into intake manifold 26 itself.

Returning to details and features of control system 60, an electronic control unit, "engine" control unit, or "ECU" 64 is coupled with detonation sensors 62, with sparkplugs 38, with admission valve 52, and also with fuel and air throttle 54. Control system 60 may further include an engine speed sensor 70, with which ECU 64 is also coupled. ECU 64 includes a computer readable memory 66 storing executable instructions for limiting detonation in combustion cylinders 16 in gaseous fuel engine 12. ECU 64 further includes a data processor 68 coupled with computer readable memory 66 and structured, by executing the executable instructions, to limit an engine load of gaseous fuel engine 12 to a derated engine load level as further discussed herein. Computer readable memory 66 can include any suitable memory such as RAM, ROM, EEPROM, DRAM, SDRAM, FLASH, a hard drive, or still another. In some instances, an existing engine control unit can be updated with suitable software to perform the operating and control actions of the present disclosure. Data processor 68 includes any suitable computerized device having a central processing unit, such as a microprocessor or a microcontroller. ECU 64 and data processor 68 are described herein interchangeably at times, and it should be appreciated no limitation is intended as to type, location, number of processors, or other aspects relating to control or structure of control system 60.

ECU 64 is coupled with detonation sensors 62 as noted above, and structured to receive detonation data produced by detonation sensors 62 indicative of a detonation level in combustion cylinders 16. A detonation level in a plurality of combustion cylinders may be an aggregate detonation level associated with detonation of gaseous fuel in at least some, and more than one, of combustion cylinders 16 in gaseous fuel engine 14. In other words, data produced by detonation sensors 62, and processed and acted upon by ECU 64, may be data that is representative of, or derived from, detonation in a plurality of combustion cylinders 16 collectively. In one example, the detonation level is, or is based on, a normalized percentage of detonation events in combustion cylinders 16 in a plurality of engine cycles. Accordingly, ECU 64 can be thought of as observing the occurrence of detonation in combustion cylinders 16 in a monitoring period, and determining percentage values representing detonation events for each cylinder in a plurality of engine cycles. For control purposes, ECU 64 may select a maximum knock or detonation value from among the normalized percentages. Thus, ECU 64 might receive data indicating cylinders 1, 2, 3, 4, etc. are experiencing detonation Q %, X %, Y %, Z %, etc., of the time and, and select the maximum of Q %, X %, Y %, or Z % as the aggregate detonation level. ECU 64 may be further structured to compare a determined detonation level to a detonation level limit, and calculate a detonation error based on the comparison of the detonation level to the detonation level limit. The detonation level limit might be some % detonation level limit that is preestablished and could be configured for different engine platforms, fuel types, and/or operating strategies.

ECU 64 is further structured to calculate a detonation error based on the comparison, and to determine an intake manifold pressure (IMAP) command based on the detonation error. Based on the determined IMAP command, ECU 64 may command a varied position of fuel and air intake throttle 54, to thereby limit an engine load of gaseous fuel engine 12 to a derated engine load level based on the commanded varying of the position of fuel and air intake throttle 54. A derated load level herein is a load level less than a rated load level, and could be 25% load, 50% load, 60% load, and so on. The varied position of fuel and air throttle 54 can include a relatively more closed throttle position based on a commanded reduced throttle area, for example. As further discussed herein, ECU 64 may command a varied position of fuel and air intake throttle 54, by way of a throttle area command that is a relatively more open throttle position that enables engine load level to increase.

Figure 2:
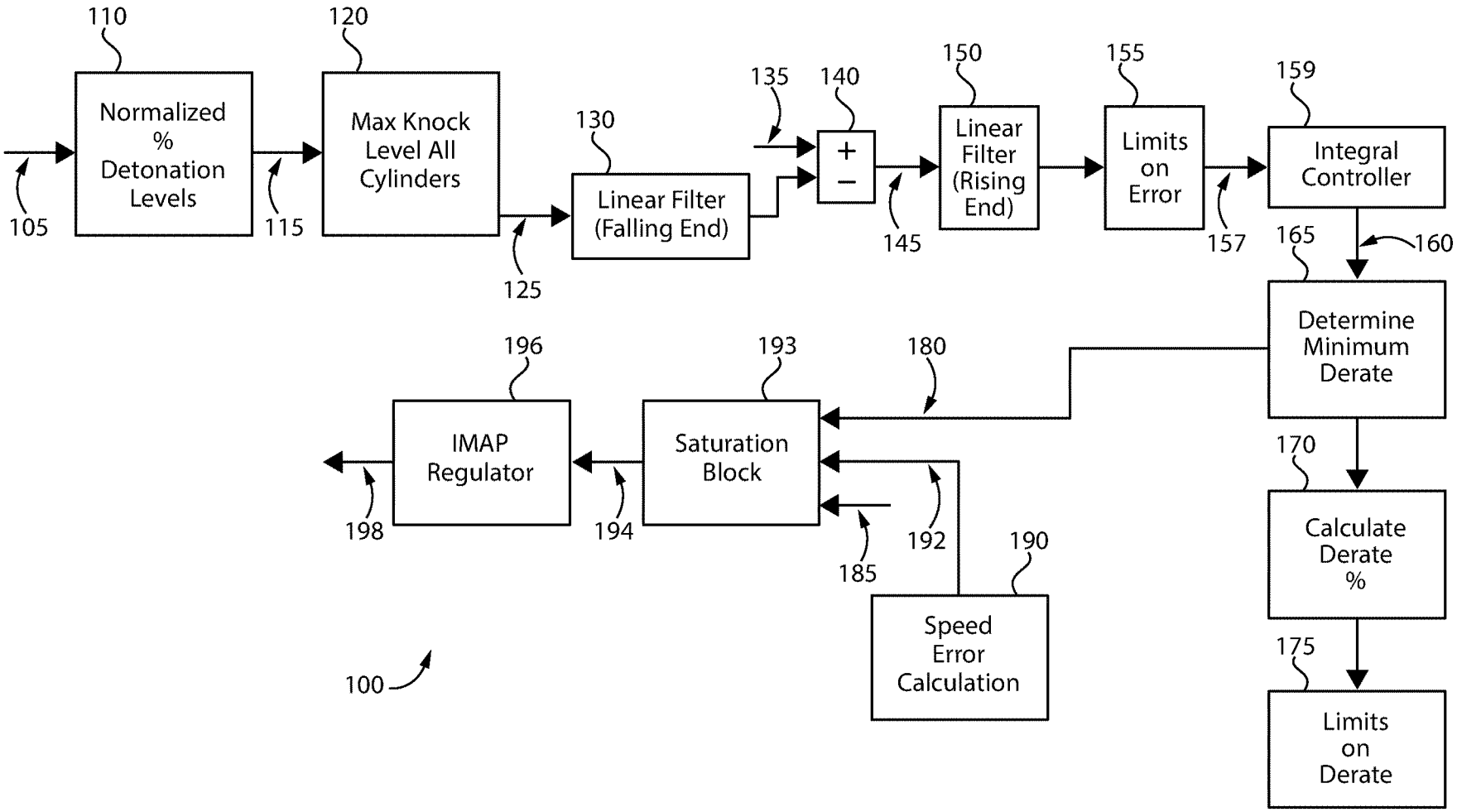
FIG. 2 is a block diagram of control logic structure and execution, according to one embodiment.

Referring also now to FIG. 2, there is shown a block diagram 100 illustrating example logic implemented by ECU 64, and data processor 68, during execution of executable instructions stored on computer readable memory 68 by data processor 66. In diagram 100, sensor data inputs are shown at 105, including sensor data produced by detonation sensors 62, for example, to a block 110 where a normalized percent of detonation levels is calculated. A detonation percent output(s) is shown at 115, to a block 120 where a max knock level among all cylinders is calculated or otherwise determined, producing a detonation term 125. Detonation term 125 might thus be a highest % detonation that is observed amongst all of combustion cylinders 16, in this example. Detonation term 125 is fed to a linear filter (falling end) 130, the output of which is received at a detonation error calculation block 140. A detonation level set point input is shown at 135, which may be a detonation level limit as discussed herein. Detonation error calculation block 140 can thus be understood as comparing filtered term 125 to a set point, to produce an error term 145 based on a difference between the detonation level set point and the filtered detonation term. Detonation error term 145 might thus be the numerical difference between the max knock or detonation level % and a set point %. If the max knock level is equal to the set point then an error value equal to 0 may be produced. If max knock level is above the set point then an error value greater than 0 may be produced, and if below the set point then a negative error value might be produced. An error value equal to or greater than 0 may mean that detonation needs to be mitigated and the engine derated, whereas a negative error value may mean detonation does not need to be addressed. Detonation error term 145 is received at a linear filter (rising end) block 150, the output of which is fed to a block 155 to apply limits on the error term. A filtered and limited error term 157 is then fed to a gain calculation block 158.

At gain calculation block 158, if error term 157 (the "detonation error") is greater than or equal to 0, then an incremental gain may be multiplied by the detonation error. If detonation error term 157 is not greater than or equal to 0, a decremental gain is multiplied by the detonation error. The calculation from block 158 is fed to an integral controller block 159. Integral controller block 159 is used to process the output of block 158 to yield a detonation-based IMAP command limit or IMAP limit 160, which may be an IMAP high limit. The IMAP high limit 160 is fed to a block 165 where a minimum derate determination occurs. At block 165 ECU 64 is understood to select a minimum derate, or relative amount of derating such as a percentage, from among other reasons to derate. For example, at block 165 a consideration such as humidity, or other engine conditions or outputs, are considered which might require a modification to IMAP limit 160. In other words, IMAP limit 160 can be thought of as an IMAP limit that will protect against detonation, but control system 60 may account for other factors that might justify a still lower IMAP high limit, for example. From block 165 an IMAP limit 180, the same as or less than IMAP limit 160, is fed to a saturation block 193. Also depicted in FIG. 2 is a calculate derate percent block 170, and a limits on derate block 175. The calculations and/or determinations of blocks 170 and 175 may be used by and forwarded to a switchgear load controller, for example.

A speed error calculation is also shown at a block 190. The speed error calculation 190 can produce an IMAP command 192 indicating a requested IMAP based on engine speed error, with saturation block 193 determining a final IMAP command 194 based on the requested IMAP command 192, the IMAP high limit 180, and an IMAP low limit 185. Another way to understand the logic at saturation block 193, is that a requested IMAP is determined based on an engine speed error, and a final IMAP command 194 determined by limiting the requested IMAP to IMAP limit 180, at least where the requested IMAP 192 is higher than IMAP limit 180. Final IMAP command 194 is fed to an IMAP regulator block 196, which determines a throttle area command 198 based on IMAP command 194 to vary a position of fuel and air throttle 54.

The logic executed in FIG. 2 can be understood as a loop calculation, thus a detonation error can include a first detonation error calculated in a first loop calculation, to reduce an IMAP of gaseous fuel engine 12. Reduction of the IMAP reduces fuel and air flow to combustion cylinder 16, and limits an engine load of gaseous fuel engine 12 to a derated engine load level. The logic in diagram 100 can be executed again, to calculate a second detonation error in a subsequent loop calculation. In the subsequent loop calculation the second detonation error might indicate that detonation is not occurring, or at least not exceeding the detonation level set point and thus the second detonation error justifies increasing IMAP of gaseous fuel engine 12, and increasing an engine load of gaseous fuel engine 12 above the derated engine load level. This strategy can enable intake manifold pressure to be decreased to mitigate detonation, and reduce engine load to a derated load level, but then permit engine load level to rise as additional loop calculations are executed. In this way, a gaseous fuel engine does not stay at a derated load level longer than is necessary, or can transition to a still derated but higher derated load level, and can accommodate transient changes in fuel quality and detonation observed when transitioning from one fuel type to another, while maximizing the engine load level that is allowed. The presently disclosed concepts can be used in conjunction with other detonation mitigation strategies, such as retarded spark timing, for instance. In one application, logic for retarding spark timing to mitigate detonation could be executed until spark timing is retarded to a maximum extent, and only then is derating operation according to the present disclosure initiated.

INDUSTRIAL APPLICABILITY

Figure 3:
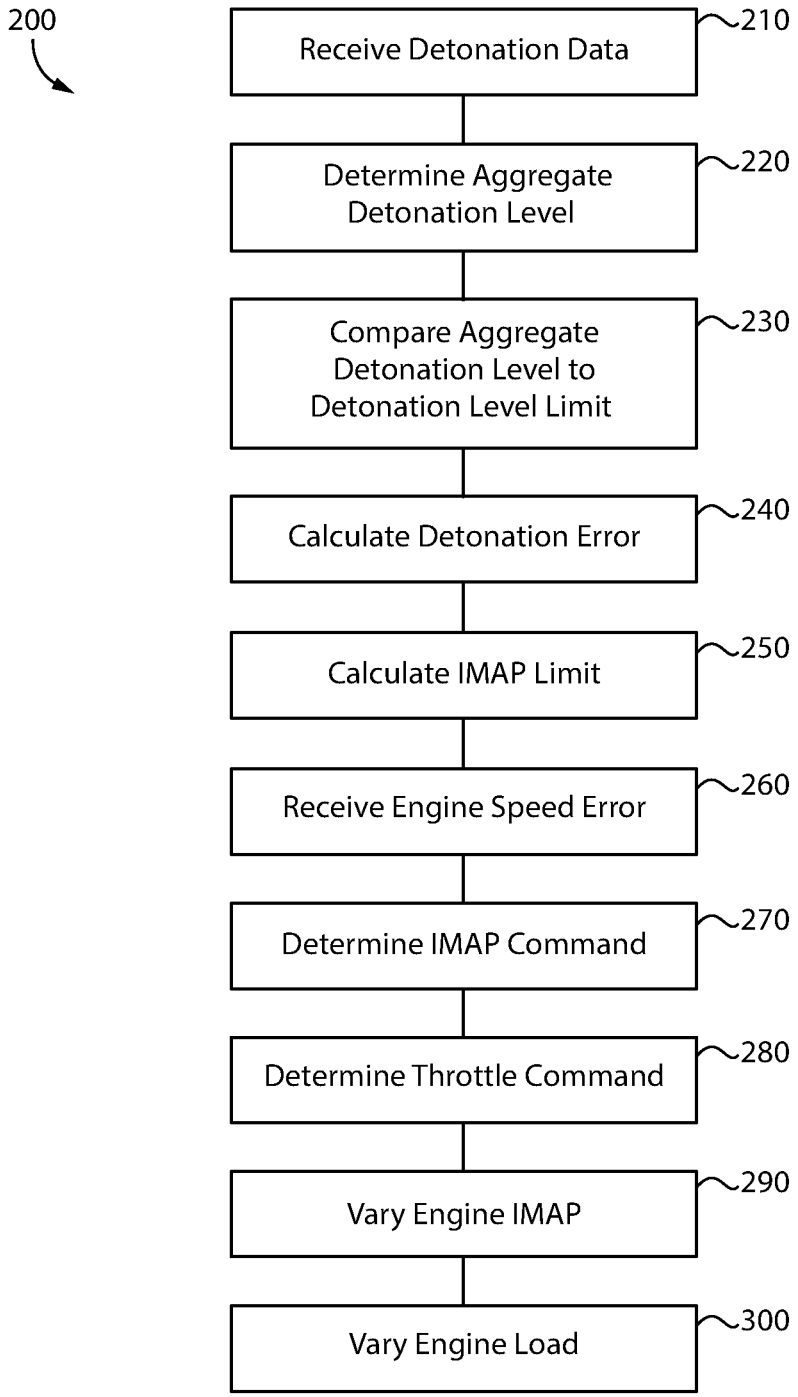
FIG. 3 is a flowchart illustrating logic and process flow, according to one embodiment.

Referring also now to FIG. 3, there is shown a flowchart 200 illustrating example logic and methodology flow. In flowchart 200, detonation data is received at a block 210, and flowchart 200 proceeds to a block 220 to determine an aggregate detonation level. From block 220 flowchart 200 advances to a block 230 to compare the aggregate detonation level to a detonation level limit. From block 230 flowchart 200 advances to a block 240 to calculate a detonation error.

From block 240, flowchart 200 advances to a block 250 to calculate an IMAP limit. From block 250, flowchart 200 advances to a block 260 to receive an engine speed error. From block 260, flowchart 200 advances to a block 270 to determine an IMAP command. From block 270, flowchart 200 advances to a block 280 to determine a throttle command. From block 280, flowchart 200 advances to a block 290 to vary engine IMAP. As discussed herein, varying engine IMAP can include reducing engine IMAP, by reducing throttle area, to limit engine load. Varying engine IMAP can also include increasing engine IMAP, such as by way of an increased throttle area to increase, or permit increasing of, engine load level. From block 290, flowchart 200 proceeds to a block 300 to vary engine load as discussed herein. From block 300, flowchart 200 could loop back to execute the described logic of blocks 210-300, or could exit, for example.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of operating an engine system comprising:
determining a detonation level associated with detonation in a plurality of combustion cylinders in an engine in the engine system;
comparing the detonation level to a detonation level limit;
calculating a detonation error indicative of a detonation level above the detonation level limit, based on the comparison of the detonation level to the detonation level limit;
reducing an engine intake manifold air pressure (IMAP) of the engine based on the detonation error; and
limiting an engine load of the engine to a derated engine load level based on the reduction to the IMAP of the engine.

2. The method of claim 1 wherein the calculating of the detonation error includes calculating a first detonation error in a first loop calculation, and further comprising calculating a second detonation error in a subsequent loop calculation.

3. The method of claim 2 further comprising increasing the IMAP of the engine based on the second detonation error, and increasing an engine load of the engine above the derated engine load level based on the increased IMAP.

4. The method of claim 1 further comprising calculating an IMAP limit based on the detonation error, and determining an IMAP command to cause the reduction to the IMAP based on the IMAP limit.

5. The method of claim 4 wherein the IMAP limit is an IMAP high limit.

6. The method of claim 4 further comprising determining an engine speed error, and determining a requested IMAP based on the engine speed error, and wherein the determining of the IMAP command includes limiting the requested IMAP to the IMAP limit.

7. The method of claim 4 further comprising igniting a gaseous fuel, for combustion in the plurality of combustion cylinders in the engine.

8. The method of claim 7 further comprising fumigating the gaseous fuel into the plurality of combustion cylinders, and determining a reduced throttle area command based on the IMAP command to vary a position of a fuel and air throttle in the engine.

9. A gaseous fuel engine control system comprising:
a plurality of detonation sensors;
an electronic control unit coupled with the plurality of detonation sensors, the electronic control unit being structured to:
receive detonation data produced by the plurality of detonation sensors indicative of a detonation level in a plurality of combustion cylinders in a gaseous fuel engine;
calculate a detonation error based on a difference between the detonation level and a detonation level limit;
determine a requested intake manifold air pressure (IMAP);
determine an IMAP command based on the detonation error to reduce the engine IMAP to an IMAP less than the requested IMAP; and
limit an engine load of the engine to a derated engine load level based on the IMAP command.

10. The control system of claim 9 wherein the detonation level is an aggregate detonation level based on a normalized percentage of detonation events in the plurality of combustion cylinders in a plurality of engine cycles.

11. The control system of claim 9 wherein the electronic control unit is further structured to determine a reduced throttle area command based on the IMAP command, and to limit the engine load to the derated engine load level based on the reduced throttle area command.

12. The control system of claim 9 wherein the electronic control unit is further structured to determine an IMAP limit based on the detonation error.

13. The control system of claim 12 wherein the electronic control unit is further structured to:

determine an engine speed error;

determine the requested IMAP based on the engine speed error; and determine the IMAP command by limiting the requested IMAP to the IMAP limit.

14. The control system of claim 13 wherein the IMAP limit is a high limit.

15. An engine control unit for a fumigated gaseous fuel engine system comprising:

a computer readable memory storing executable instructions for limiting detonation in combustion cylinders in a gaseous fuel engine;

a data processor coupled with the computer readable memory and structured, by executing the executable instructions, to:

determine a detonation level associated with detonation of gaseous fuel in the combustion cylinders;

compare the detonation level to a detonation level limit;

calculate a detonation error indicative of a detonation level above the detonation level limit, based on the comparison of the detonation level to the detonation level limit;

determine an intake manifold pressure (IMAP) command based on the detonation error to reduce IMAP in the engine;

command a varied position of a fuel and air intake throttle in the fumigated gaseous fuel engine based on the IMAP command; and limit an engine load of the fumigated gaseous fuel engine to a derated engine load level based on the commanded varying of the position of the fuel and air intake throttle.

16. The engine control unit of claim 15 wherein the detonation level includes an aggregate detonation level based on a normalized percentage of detonation events in the plurality of combustion cylinders.

17. The engine control unit of claim 16 wherein the data processor is further structured to determine the aggregate detonation level based on a maximum knock level of the combustion cylinders.

18. The engine control unit of claim 15 wherein the data processor is further structured to determine an IMAP high limit based on the detonation error, to calculate an engine speed error, and to determine a requested IMAP based on the engine speed error.

19. The engine control unit of claim 18 wherein the requested IMAP is higher than the IMAP high limit, and the data processor is further structured to determine a reduced area throttle command, to cause the varying of the position of the fuel and air throttle, by limiting the requested IMAP to the IMAP high limit.

20. The engine control unit of claim 15 wherein the detonation error is a first detonation error calculated in a first loop calculation, and the data processor is further structured to calculate a second detonation error in a subsequent loop calculation, and to determine an increased area throttle command based on the second detonation error.

* * * * *